United States Patent [19]

McNally

[11] Patent Number: 4,735,416

[45] Date of Patent: Apr. 5, 1988

[54] AUTOMATIC ROULETTE APPARATUS

[75] Inventor: Gordon McNally, London, England

[73] Assignee: The McNally Design Group Ltd., London, England

[21] Appl. No.: 815,891

[22] Filed: Jan. 3, 1986

[30] Foreign Application Priority Data

Jan. 4, 1985 [GB] United Kingdom ..... 8500135

[51] Int. Cl.[4] ..... A63F 5/00

[52] U.S. Cl. ..... 273/142 B; 273/138 A; 273/142 E; 273/125 A

[58] Field of Search ..... 273/1 E, 85 G, 138 A, 273/143 R, 142 R, 142 A–142 H, 142 HA, 142 J, 142 JA, 142 JB, 142 JC, 142 JD, 122 A, 125 A

[56] References Cited

U.S. PATENT DOCUMENTS 4,396,193 8/1983 Reinhardt ..... 273/138 A

*Primary Examiner*—Maryann Lastova

*Attorney, Agent, or Firm*—Wenderoth, Lind & Ponack

[57] ABSTRACT

A roulette apparatus has a table, a roulette wheel mounted to spin about a vertical axis with respect to the table, the wheel having a plurality of ball receptor cups at the periphery thereof and having a hub portion and a rim portion. The hub and rim portions are displaceable axially with respect to each other between a "play" position and a "return" position, for forming a gap between the hub portion and the rim portion when the hub and rim portions are in the "return" position. A return channel is provided beneath the wheel, whereby when a ball has been projected onto the spinning wheel and has fallen into one of the cups, and the hub and rim portions have been displaced to the "return" position, the ball rolls from the cup into which it has fallen, rolls through the gap, and then falls to the return channel.

5 Claims, 10 Drawing Sheets

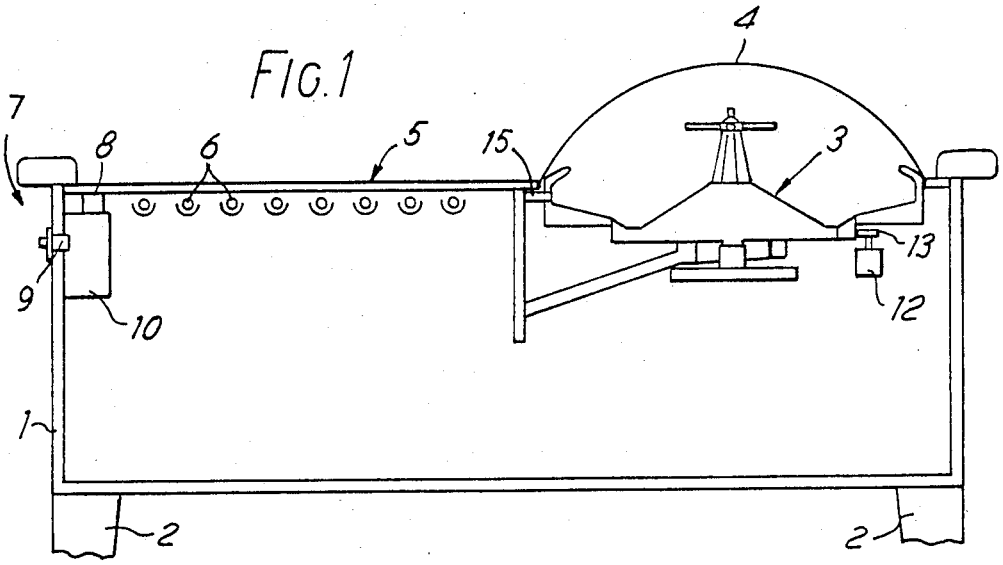
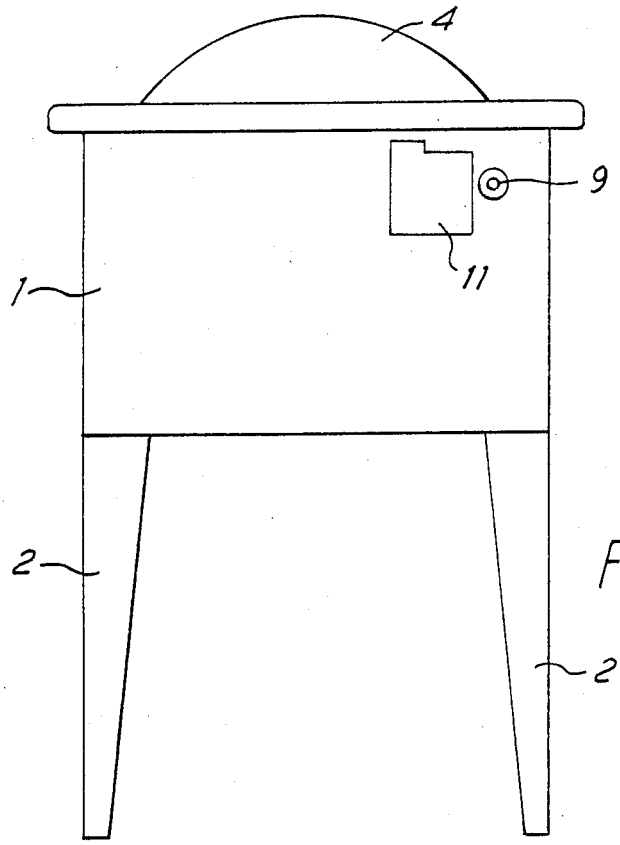
FIG. 2

AUTOMATIC ROULETTE APPARATUS

The invention relates to an automatic apparatus for playing roulette. The apparatus can be used for amusement only, or for gaming.

In roulette, a ball is cast at a spinning wheel which is provided with a number of cups. Bets are placed in accordance with forecasts made of the cup into which the ball will fall and winnings paid in accordance with the particular cup into which the ball falls. Conventionally, a croupier is engaged to spin the wheel, cast the ball, collect the stakes and pay out winnings. It is an object of the invention to provide a machine which automatically performs the function of the croupier on operation by the player or players. The invention provides solutions to problems in achieving this object. A major problem is detection of the cup into which the ball falls.

According to one aspect of the invention there is provided roulette apparatus comprising a table; a roulette wheel mounted to spin with respect to the table about a vertical axis; a number of ball-receptor cups at the periphery of the wheel, one of the cups being a reference cup; a ball which is projected on to the spinning wheel so as to fall into one of the cups; and indentifying means for indentifying the cup into which the ball falls, the indentifying means comprising a counting system for counting the passage of the cups past a reference position and giving a corresponding count output; a reset arrangement for resetting the count in response to the passage of the reference cup past the reference position; and a ball sensor responsive to the passage of the ball in a cup past the reference position and effective to register the count at that time. With this arrangement the wheel can be allowed to spin for several revolutions after the ball has come to rest and successive oup indentifications compared before a "game over" output is given and the wheel brought to rest. This avoids erroneous outputs while the ball may be bouncing from cup to cup.

The counting system is preferably electro-optical by light either transmitted through or reflected from a disc fixed to the wheel. Preferably the ball detector is electro-magnetic, the ball including metallic material which can be detected by the detector, the wheel itself being of non-metallic material, preferably plastics. The ball may have a plastics body which includes perhaps a metallic sphere or dispersed metallic particles. The weight and bounce characteristics of the ball can be adjusted by selection of appropriate materials.

Another difficulty with an automatic roulette machine is in retrieving the ball from the cup into which it has fallen. According to another aspect of the invention there is provided roulette apparatus comprising a table; a roulette wheel mounted to spin with respect to the table about a vertical axis, the wheel having a hub portion and a rim portion; means for displacing the hub and rim portions axially with respect to each other between a "play" position and a "return" position, a gap being made between the hub portion and the rim portion when the hub and rim portions are in the "return" position; and a return channel beneath the wheel, the ball being allowed to return by displacement of the hub and rim portions to the "return" position whereby the ball rolls from the cup into which it has fallen, rolls through the gap, and thence falls to the return channel.

The rim of the wheel may be lowered to effect the said axial displacement. Preferably, however, the central hub is raised.

Means for registering cup number forecasts via the table may be provided comprising a switch membrane situated over the table surface and having switch contacts positioned according to the table markings, whereby forecasts are registered by touching the appropriate marked areas of the table. Preferably the membrane is translucent and lamps are provided beneath it, so that registered selections remain illuminated during the game.

Preferably the apparatus is operated by coin or token. In the gaming version, a pay-out mechanism is provided to deliver to the player the number of coins or tokens appropriate to any winnings, as registered by a calculating means. In the amusement version, the calculating means gives an indication by means of a display of any winnings which would have accrued.

Preferably the means for calculating and registering "wins" comprises a micro-processor programmed to receive inputs from the table membrane and the cup indicator and effective to calculate appropriate "win returns" in accordance with a preset pattern of odds. In the gaming version of the invention, automatic pay-out of coins or tokens may be initiated.

Use of a micro-processor with a memory allows a further facility. This is the display of the last few winning numbers. This facility will appeal to those who seek to employ a systematic scheme to play the game or who simply try to detect a pattern or sequence in the winning numbers.

The invention will further be described with reference to the accompanying drawings, of which:

FIG. 1 is a schematic cross-sectional side elevation of apparatus in accordance with the invention;

FIG. 2 is an end elevation of the apparatus of FIG. 1;

Figure 3:
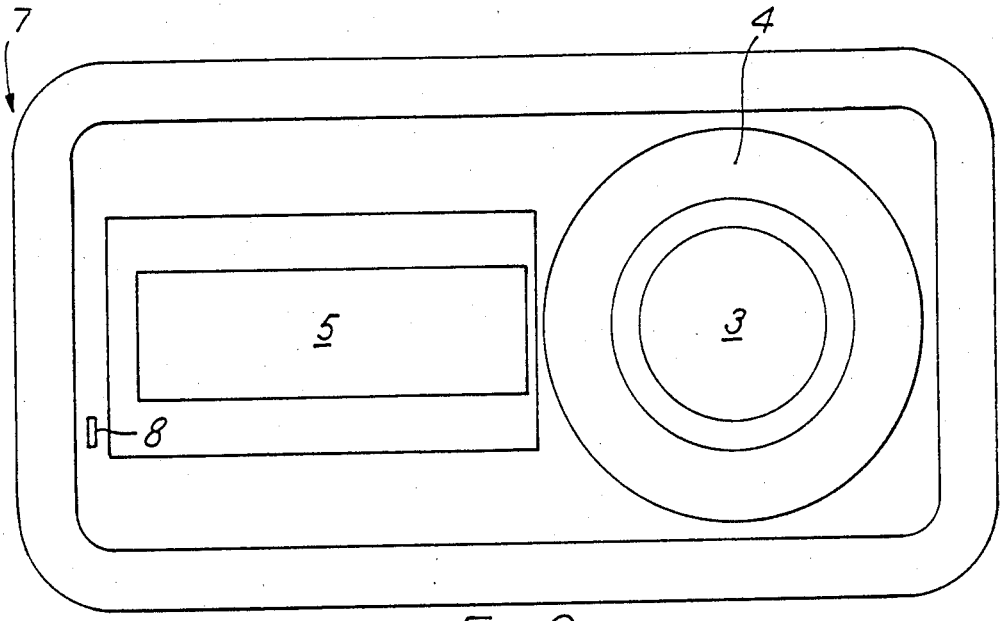
FIG. 3 is a plan view of the apparatus.

Referring to FIGS. 1 to 3 the apparatus comprises a box-like case 1 mounted on legs 2 and having a roulette wheel 3 at one end under a transparent dome 4. A playing table 5 is marked in areas and is translucent. Electric bulbs 6 illuminate respective areas at appropriate times.

The apparatus in this embodiment is coin-operated and a player stands at end 7 where there is a coin slot 8 and a ball firing button 9. The coin slot leads to a coin mechanism 10 and there is a pay-out tray at 11 to receive winnings from the coin mechanism. When the required money is inserted and bets made, in a manner to be described, the roulette wheel is spun by an electric motor 12 which turns a rubber-faced drive wheel 13 held in frictional engagement with the periphery of the roulette wheel. The ball-firing button is pressed and a ball is fired from a chute 15 on to the roulette wheel. A detector mechanism to be described detects the cup into which the ball falls and any winnings are automatically calculated and paid out via the pay-out tray 11.

Figure 4:
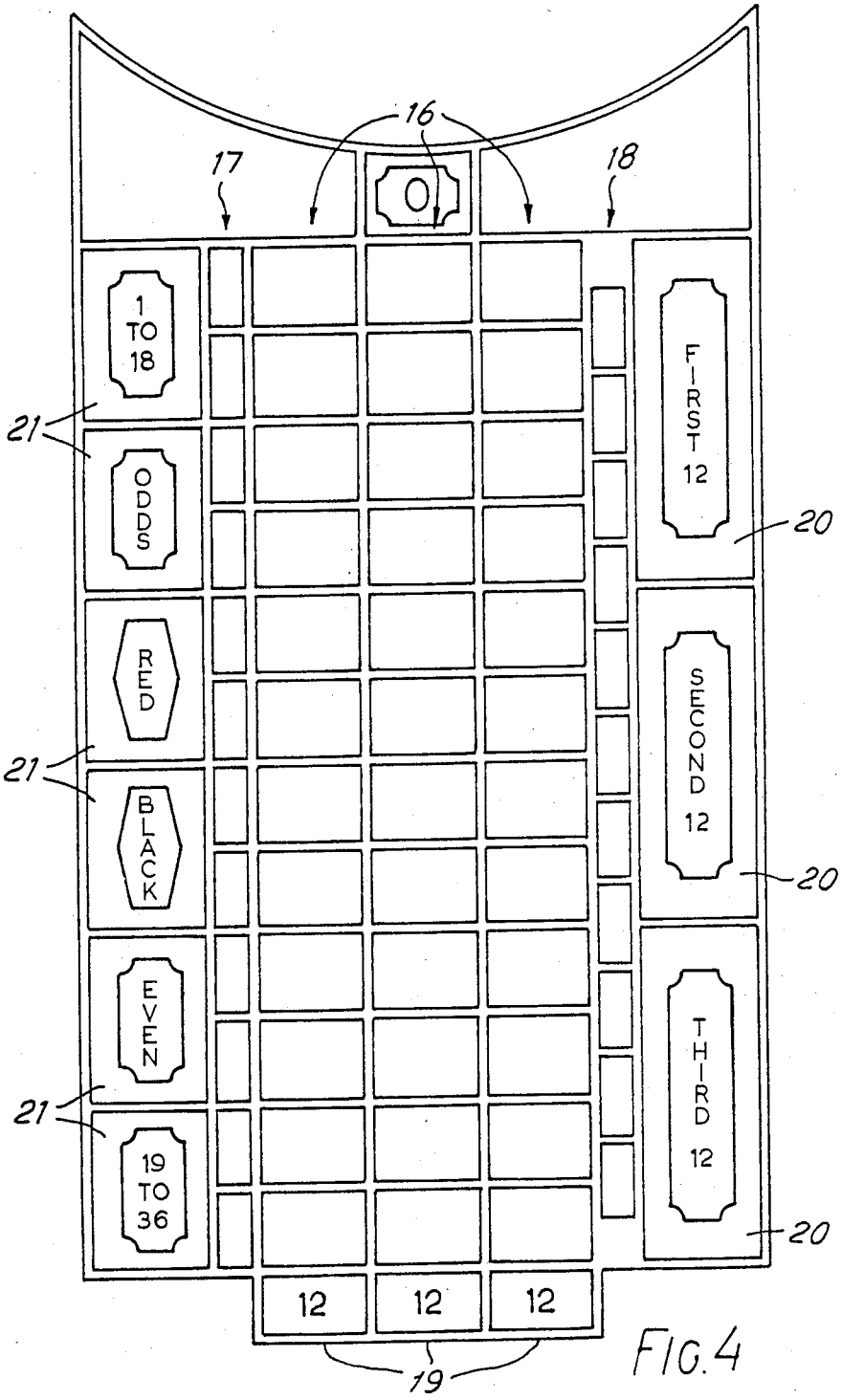
FIG. 4 is a diagram of the playing table of the apparatus.

Referring now to FIG. 4 the playing table is composed of a touch-sensitive membrane which is translucent and divided into a number of playing areas. Bets are placed and registered by touching an appropriate area or areas which are then illuminated. The numbers 1 to 36 are represented by respective areas in three colums 16 of twelve. At the head of the middle column is an area designating the number zero. The set of three columns is flanked by a series of group-selective areas. On the left-hand side are twelve areas 17 whereby the corresponding row of three numbers may be selected simultaneously. On the right-hand side are eleven areas 18 whereby the adjacent six numbers may be selected simultaneously. At the base is a set of three areas 19 whereby a complete row of twelve numbers may be selected simultaneously.

At the extreme right of the table are three areas 20 whereby groups of twelve numbers may be selected simultaneously, namely the first twelve, the second twelve or the third twelve. At the extreme left-hand side is a set of six areas 21 whereby groups of eighteen numbers may be selected simultaneously, namely evens, odds, the first eighteen, the last eighteen, red numbers and black numbers.

Also provided but not shown in FIG. 4 is a cancel area, whereby bets may be cancelled and changed before play begins. Furthermore, a preferred feature also not shown is a display of the last six winning numbers.

Figure 6:
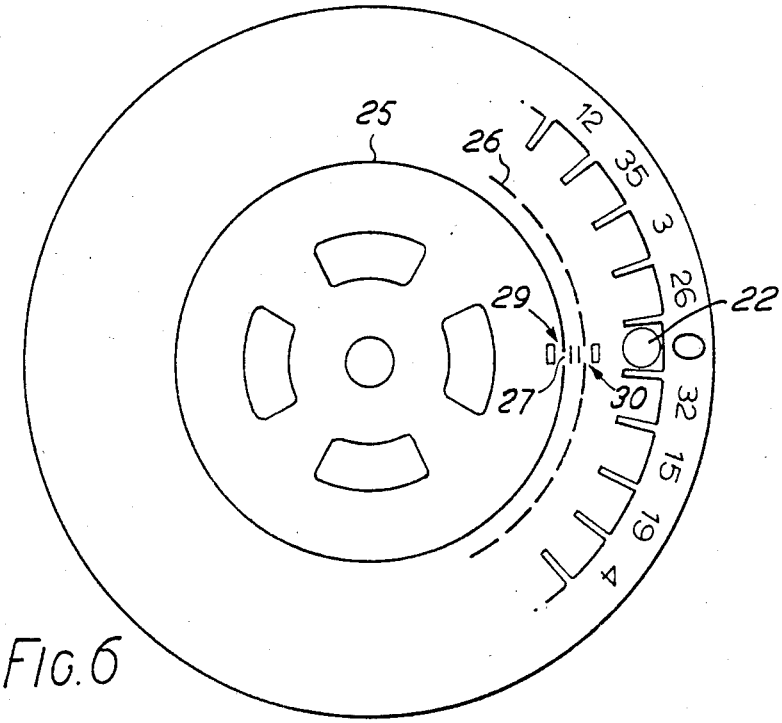
FIG. 6 is a plan view of the arrangement of FIG. 5.
Figure 5:
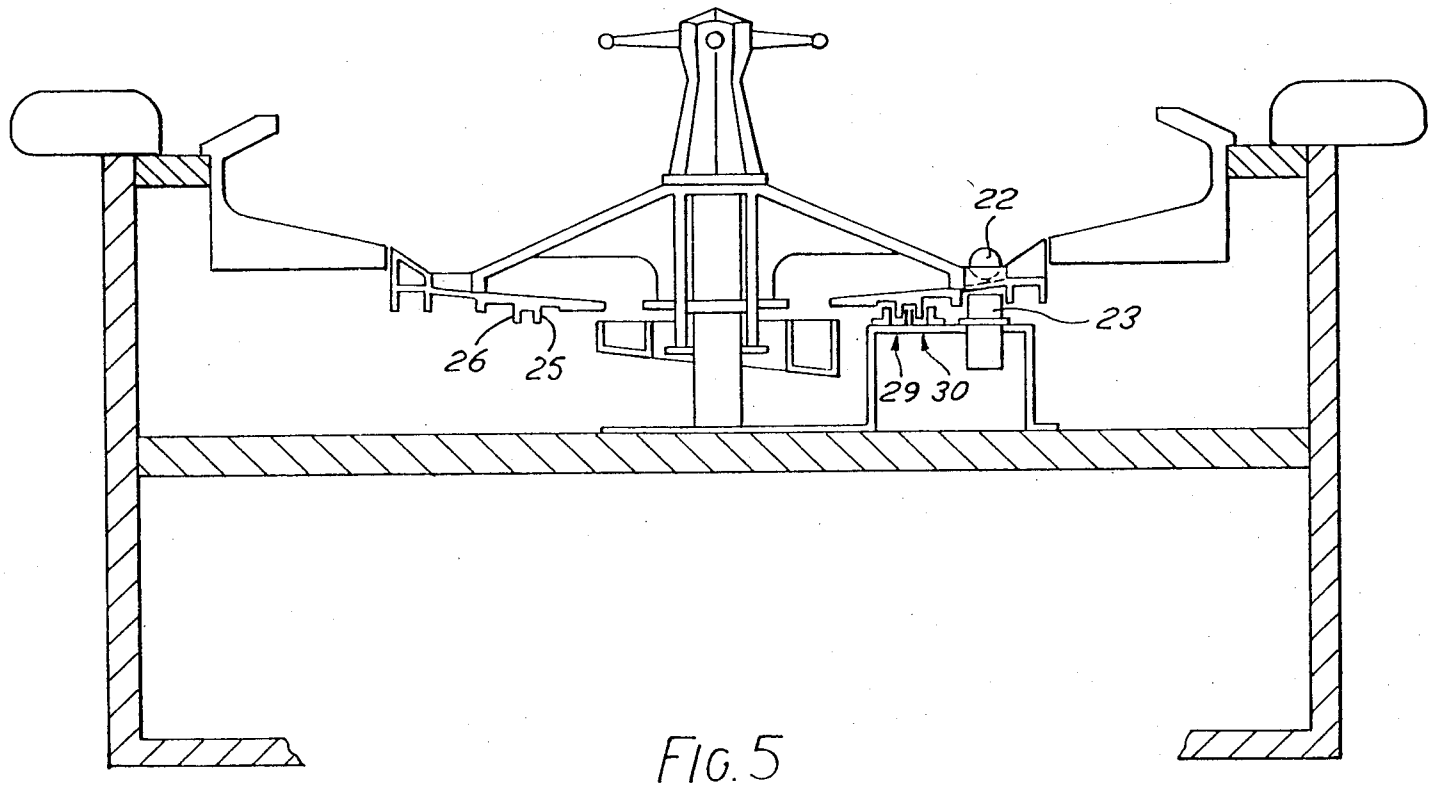
FIG. 5 is a schematic side elevation of the arrangement for identifying the cup into which the ball falls.

Referring now to FIGS. 5 and 6 there is shown the means for detecting the cup into which the ball has fallen, while the wheel is still spinning. The ball 22 is made of a hollow steel sphere covered with a plastics shell. The shell gives the required bounce characteristics while the sphere allows detection of the ball by a proximity detector probe 23, which is based on a high-frequency metal-detection principle. The wheel is made of plastics material which does not interfere with the ball detector. However, the upper surface of the plastics wheel is provided with a metallised mirror finish. The metallised layer is extremely thin but nevertheless the proximity probe is designed to avoid the influence of this by being arranged to respond primarily to the ferro-magnetic properties of the steel of the ball.

Detector 23 is a self-contained unit provided on a printed-circuit board, receiving a d.c. input and giving a shaped output pulse on detection of the ball. The detector comprises a coil and the printed circuit board carries an oscillator for energizing the coil, a detector circuit responsive to field changes at the coil in response to the ferro-magnetic material of the ball, and a pulse shaping circuit. In FIG. 6 the ball is shown in cup zero.

In order to identify the cup in question there is provided an optical counter. Depending from the underside of the wheel are two annular ribs 25, 26. The inner rib 25 is opaque except for a slot 27 at the position of the zero cup. The outer rib 26 is opaque except for the slots at each cup position. Two photo-detector units 29 and 30 are provided. Each unit comprises a light-emitting diode and a photo-detector cell on opposed limbs of a U-shaped support. The units comprise respective amplifier and pulse shaping circuits so that a shaped square pulse is given each time the light path between the light emitting diode and the photo-detector cell is cleared. Unit 29 is a reference unit and is positioned to straddle the inner rib 25. The ribs constitute annular shutters, one with a single slot and the other with a slot for each cup. A reference output pulse is given when the reference slot 27 passes, or in other words each time a reference cup passes. Unit 30 is a cup-counting unit and straddles rib 26, so that a pulse is given each time a slot at a cup position passes, or in other words each time a cup passes.

Figure 7:
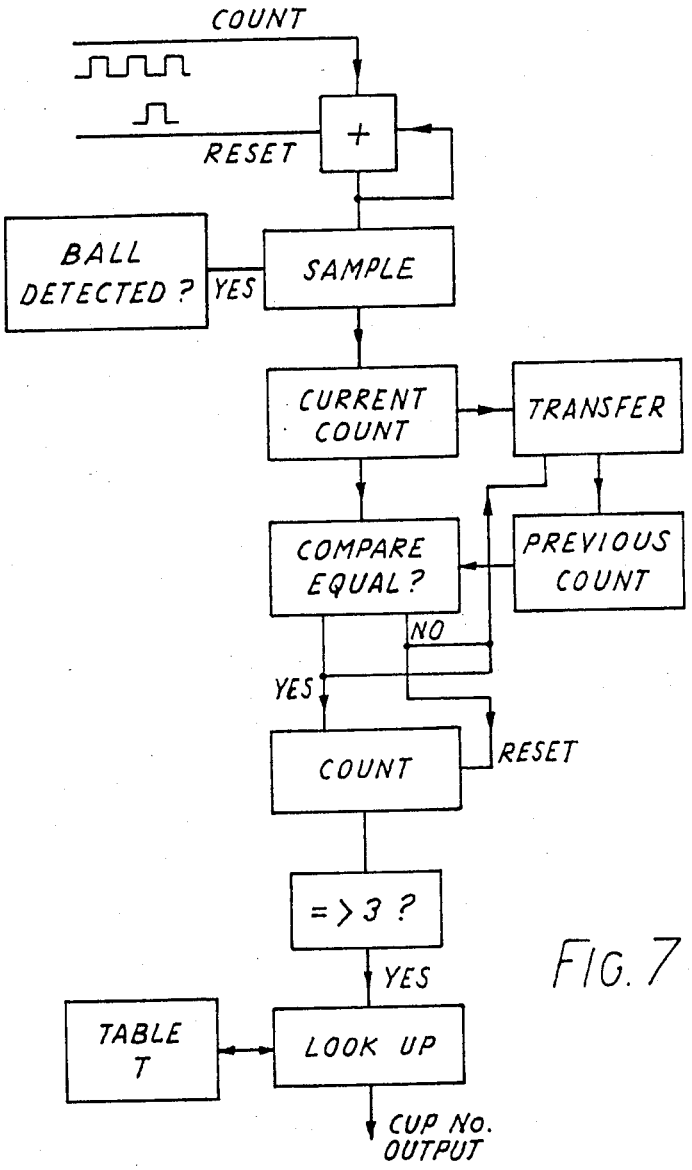
FIG. 7 is a computer program flow chart for the cup indicator arrangement.

The machine is controlled by a micro-processor and FIG. 7 is a flow-chart diagram of the part of the micro-processor program which identifies the cup into which the ball has fallen. Cup pulses from unit 30 (FIG. 6) are counted by an adding function at 31, the count total being incremented by each pulse. Pulses from reference unit 29 reset the count in the adding memory to zero, as indicated at 32.

An input state derived from the ball detector 23 is interrogated periodically at 33 and if found affirmative, indicating detection of the ball, the program samples the current count output and holds it at 34. A region of the micro-processor memory 35 holds a number representative of the previous count. The previous count and current count are compared at 36. If they are the same an addition is made to a count held at 37. If they are not the same the count at 37 is reset to zero. Whether the previous count and current count are the same or not a transfer function 38 is initiated after the comparison has been made. This replaces the previous count at 35 with the current count at 34.

When three successive comparisons have shown no change an output condition is initiated which examines a look-up table in the micro-processor memory. This contains a table T of cup numbers with respect to cup positions from the reference point (slot 27). Thus an output is given to register the cup number and initiate the appropriate "game over" procedure.

Successive comparisons as described above ensure that an output is not given unless the ball is detected in the same cup in three successive revolutions of the wheel, and has therefore stopped bouncing from cup to cup.

Figure 8:
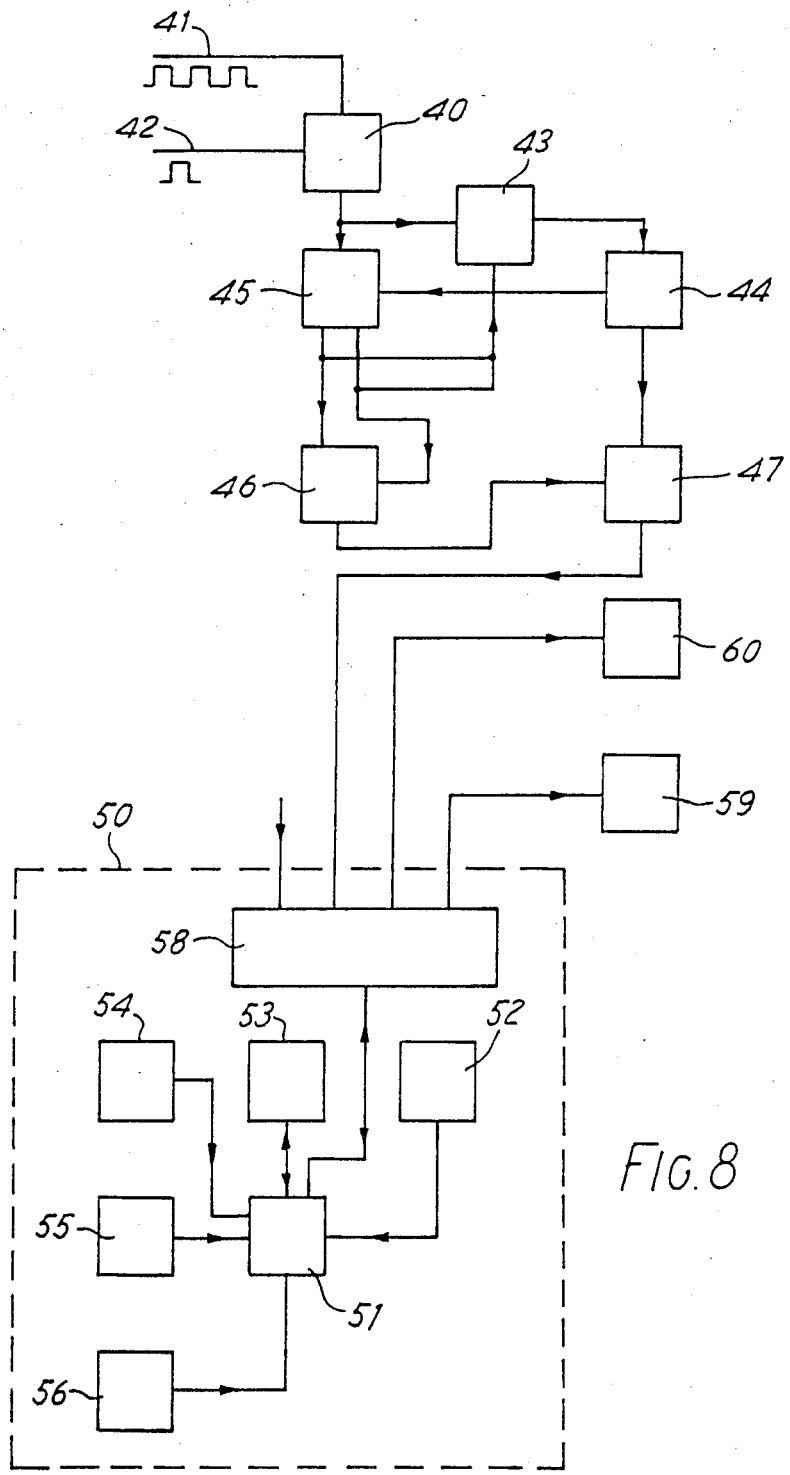
FIG. 8 is a block circuit diagram of an equivalent cup indicator arrangement.

FIG. 8 shows a modification of the arrangement of FIG. 7. Here the ball detection function is effected by dedicated circuitry instead of being part of the micro-processor program as in FIG. 7. In FIG. 8 an integrated circuit shift register constitutes a counter 40 to count the cup pulses from unit 30 (FIG. 6) via a line 41. The counter 40 is reset to zero by pulses from the reference unit 29 (FIG. 6) via a line 42. The counter output is applied as a parallel number via a gate 43 to a further register 44 which acts as a hold register.

A comparator 45 is triggered by signals from the ball detector 23 so that when a ball is detected the numbers held in registers 40 and 44 are compared. If they are the same a count in a counter 46 is incremented. If they are different the count in counter 46 is set to zero. When the count in counter 46 reaches 3 a gate 47 is opened to apply the ball count number from register 44 to the input of the micro-processor which is shown at 50. The count in register 44 is updated after each comparison by operation of the transfer gate 43.

It will be seen that the arrangement described is equivalent to the program described with reference to FIG. 7, the difference being that dedicated circuit elements 40 to 47 are used instead of the micro-processor facility. Otherwise, the micro-processor functions of both embodiments are the same. These will now be described with reference to FIG. 8.

The micro-processor comprises a central processing unit (CPU) 51; a clock 52; a random access memory (RAM) 53; read-only memories (ROM's) 54 to 56; and an input/output system 58 with appropriate ports. The input/output system receives inputs from various condition switches of the machine, including the table membrane switches, the firing button, a tilt switch, and, if used, coin box switches. Input is also received from the cup detector system as described above. Output is supplied to operate the display lamps, shown schematically at 59, in predetermined sequences; to give audio input to a sound system 60; if used in a gaming mode to pay out winnings; and to display the winning number sequence.

The ROM units include a program ROM 54 which carries the controlling program for the machine and a data ROM 55 which carries data such as the wheel cup number table (table T of FIG. 7) and also tables of winning odds according to the forecast cup combinations. Also there is a ROM 56 which carries digitized voice data. When read out and applied to the sound system, the voice data gives predetermined messages, such as "place your bets" and "no further bets". It can also be arranged to recite the winning numbers when detected.

Figure 9:
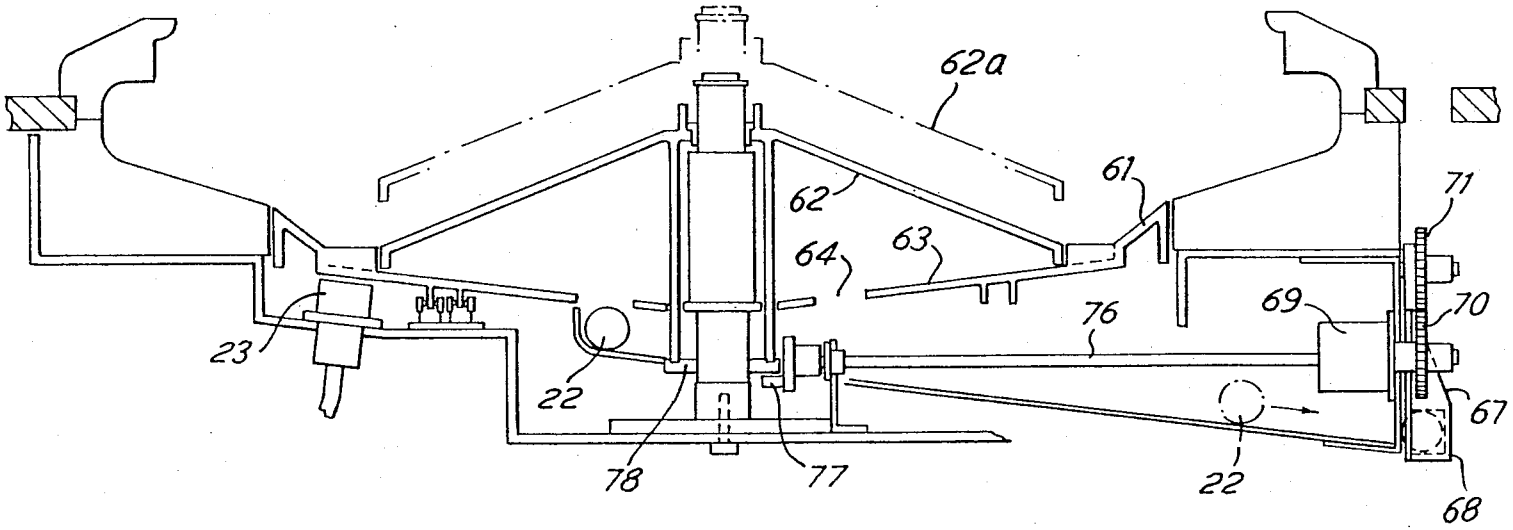
FIG. 9 is a schematic elevation of the ball return mechanism of the apparatus.
Figure 10:
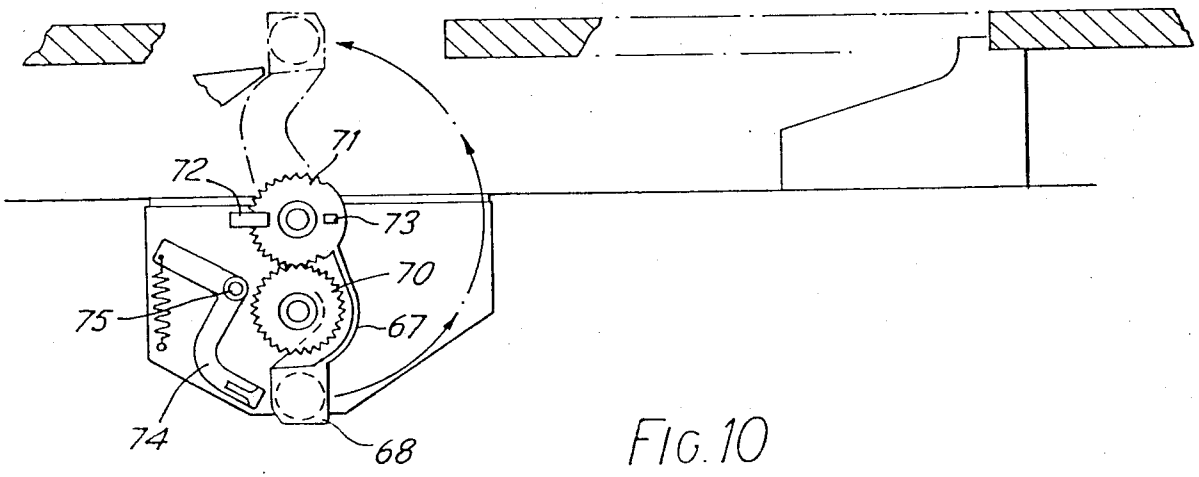
FIG. 10 is a diagram of a detail of the mechanism of FIG. 9.
Figure 11:
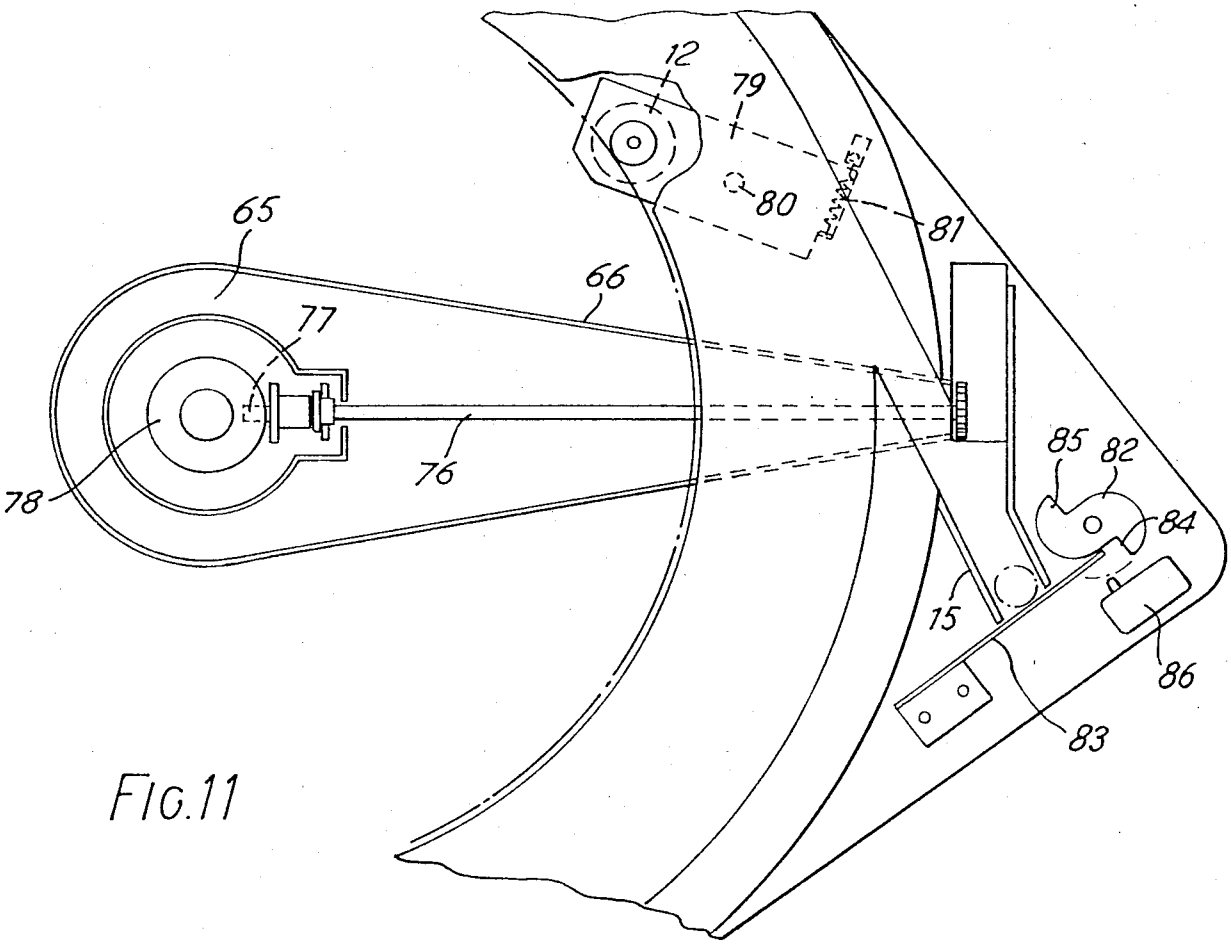
FIG. 11 is a part plan view showing the ball-firing mechanism.

Referring now to FIGS. 9 to 11 there is shown the ball return mechanism of the roulette wheel. The wheel is divided into a rim 61 which has the cups and a hub 62 of conical form. The hub is capable of being elevated several centimeters to the position shown in broken line at 62*a*. When the hub is raised the ball is allowed to roll out of the cup it occupies and down an incline 63 to drop through an aperture 64. An annular collector channel 65 directs the ball to a return chute 66.

At the bottom of the return chute is a return arm 67 with a pocket 68 at its end. The ball is caught in the pocket. At the appropriate time an electric motor 69 is energized. This turns a gear wheel 70 in the clockwise direction as seen in FIG. 10, so turning another gear-wheel 71 with which it meshes in an anticlockwise direction. Arm 67 is mounted on wheel 71 and by rotation of the arm the ball is thus raised to the level of the wheel. At the top of the stroke the arm allows the ball to roll from the pocket and into the firing chute 15 (FIG. 11). A photocell arrangement 72 responds to the presence of two apertures in wheel 71, one of which is shown at 73. In this way the motor 69 is controlled to drive the arm 67 for one-half revolution only, first in one direction and then in the other.

A spring-loaded shutter arm 74 is pivoted at 75 and is normally in a position to block the outlet from chute 66. The arm is pushed aside by the pocket 68 when the pocket returns to its pick-up position at the bottom of its stroke. This arrangement allows the use of two or more balls, since they may be queued in the chute 66, one ball at a time being allowed in to the pocket 68, and the others being retained by the shutter arm when the pocket has moved away.

The motor 69 has a shaft 76 which has at its end a crank pin 77. This pin engages a thrust ring 78 at the base of the hub and is effective to raise the hub to the position shown at 62*a* when the motor is turned half a revolution. In this way the hub is raised to allow a ball to drop simultaneously with return of another ball to the firing chute 15.

FIG. 11 shows the wheel drive arrangement. The drive motor 12 is mounted beneath a swing plate 79 pivoted at 80. The drive wheel 13 is mounted above the plate and is urged into contact with the rim of the roulette wheel by means of a spring 81.

FIG. 11 also shows the ball firing mechanism. A double-lobed cam 82 is turned by a motor and gear-box (not shown) when a ball is to be fired. A leaf spring 83 is urged back by the cam as it rotates. Finally, the spring is released by the cam step 84 or 85 and strikes the ball 22, so firing it at the roulette wheel which by this time is spinning. The two lobes of the cam are not identical; in particular the step depths are different. In this way the ball is struck differently in successive plays of the game, so enhancing the random effect of the ball's destination. A microswitch 86 is contacted by the leaf spring 83 at the end of its travel. This allows a signal to be provided indicative that (a) the ball is about to be fired and (b) that it has been fired.

Figure 12:
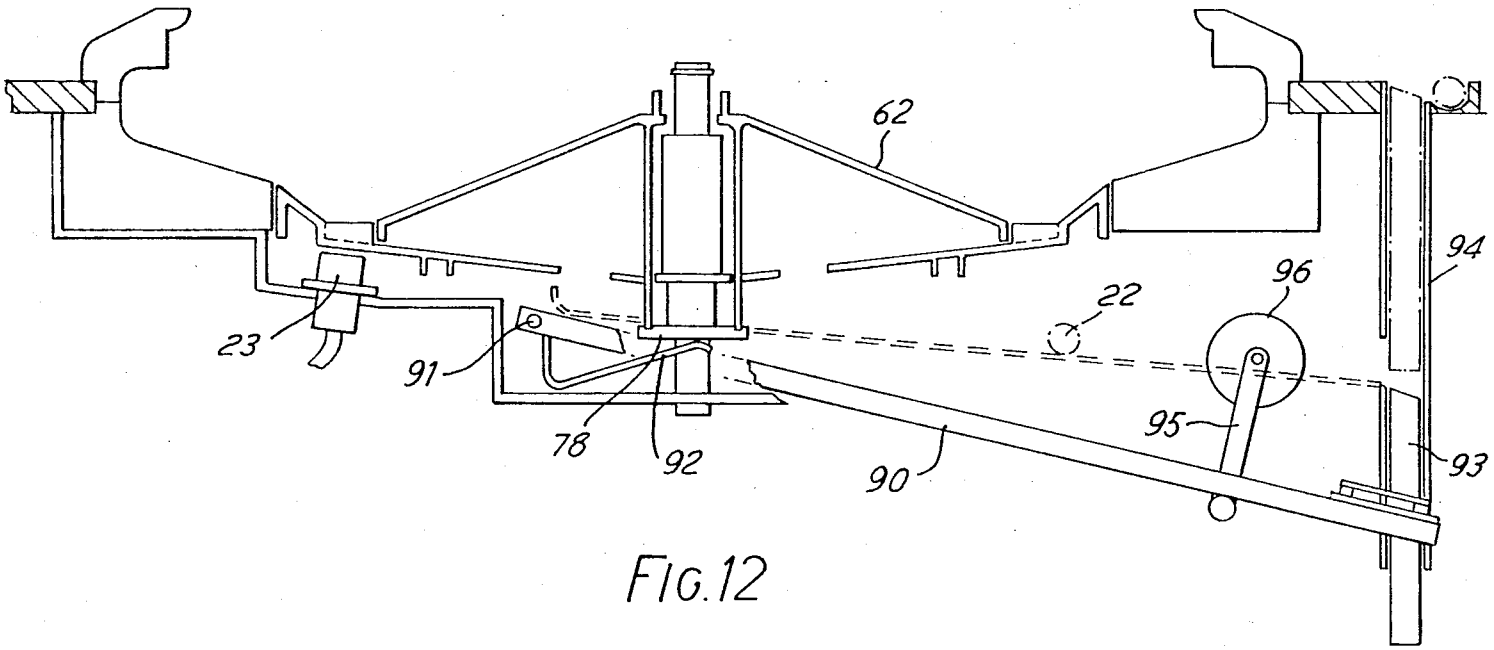
FIG. 12 is a schematic elevation of another ball return mechanism which may be used in the apparatus.

Referring now to FIG. 12 there is shown an alternative arrangement for raising the hub of the wheel and for returning the ball. An operating lever 90 is pivoted at 91 and has a fork 92 attached. Fork 92 engages the thrust ring 78 of the hub 62. The end of arm 90 carries a piston 93 which runs in a return tube 94. Chute 66 returns the balls 22 to the tube 94 where they enter and rest on the inclined top of piston 93. A crank arm 95 is rotated by a motor 96 and raises and lowers the lever 90, thus raising a ball in the return tube and simultaneously lifting the hub 62.

The invention is not restricted to the details of the embodiments described above with reference to the drawings. For example, instead of an electromagnetic detector for the ball, an optical detector may be used in conjunction with a transparent or translucent wheel and appropriate overhead lighting, perhaps infra-red. Cup counting may be by means of magnetic detectors instead of optical detectors.

It is to be noted that the reference position for detection of (a) the passage of the cups (b) the passage of the reference cup and (c) the passage of the ball need not be physically on the same radius of the wheel. These positions may be fixed at any convenient point and the outputs referred to a notional reference position by computation.

In the ball retrieval arrangement it is envisaged that instead of the central hub being raised with respect to the rim portion, it may be lowered to present a gap through which the ball may roll to be collected.

I claim:

1. Roulette apparatus comprising: a table; a roulette wheel mounted to spin about a vertical axis with respect to the table, the wheel having a plurality of ball receptor cups at the periphery thereof and having a hub portion and a rim portion; means for displacing the hub and rim portions axially with respect to each other between a "play" position and a "return" position, for forming a gap between the hub portion and the rim portion when the hub and rim portions are in the "return" position; and a return channel beneath the wheel, whereby when a ball has been projected onto the spinning wheel and has fallen into one of said cups, and the hub and rim portions have been displaced to the "return" position, the ball rolls from the cup into which it has fallen, rolls through the gap, and thence falls to the return channel.

2. Roulette apparatus as claimed in claim 1 wherein said displacing means comprises means to raise said hub to effect the displacement.

3. Roulette apparatus as claimed in claim 2 further comprising means for lifting a ball from said return channel to a position for projecting it onto said roulette wheel and a return motor connected to said hub and to said lifting means and which on operation simultaneously raises the hub and lifts a ball from the return channel to the projecting position.

4. Roulette apparatus as claimed in claim 3 wherein said lifting means comprises a rotable return arm having a pocket carried at the end thereof for receiving the ball from said return channel and lifting it by virtue of rotation of said arm by the motor.

5. Roulette apparatus comprising:

a table;

a roulette wheel mounted to spin about a vertical axis with respect to the table;

a plurality of ball-receptor cups at the periphery of the wheel, one of said cups being a reference cup;

a ball for being projected on to the spinning wheel so as to fall into one of the cups, said wheel having a hub portion and rim portion and means for displacing the hub and rim portions axially with respect to each other between a "play" position and a "return" position for forming a gap between the hub portion and the rim portion when the hub and rim portions are in the "return" position, and a return channel beneath the wheel, whereby when the hub and rim portions are displaced to the "return" position, the ball rolls from the cup into which it has fallen, rolls through the gap, and thence falls to the return channel; and indentifying means for indentifying the cup into which the ball falls, the indentifying means having a counting system for counting the passage of the cups past a reference position and giving a corresponding count output, a reset arrangement for resetting the count in response to the passage of the reference cup past the reference position, and a ball sensor responsive to the passage of the ball in a cup past the reference position and effective to register the count at that time.

* * * * *